US011167173B2

(12) United States Patent
Cone

(10) Patent No.: US 11,167,173 B2
(45) Date of Patent: Nov. 9, 2021

(54) PHYSICAL THERAPY AND FITNESS DEVICE: RESISTANCE BAND WITH PEDALS

(71) Applicant: Elly Frymire Cone, River Forest, IL (US)

(72) Inventor: Elly Frymire Cone, River Forest, IL (US)

( * ) Notice: Subject to any disclaimer, the term of this patent is extended or adjusted under 35 U.S.C. 154(b) by 16 days.

(21) Appl. No.: 16/708,070

(22) Filed: Dec. 9, 2019

(65) Prior Publication Data

US 2021/0170235 A1 Jun. 10, 2021

(51) Int. Cl.

| | |
|---|---|
| ***A63B 21/00*** | (2006.01) |
| ***A63B 21/055*** | (2006.01) |
| ***A63B 21/04*** | (2006.01) |
| ***A63B 26/00*** | (2006.01) |

(52) U.S. Cl.

CPC ..... *A63B 26/003* (2013.01); *A63B 21/00043* (2013.01); *A63B 21/04* (2013.01); *A63B 21/0557* (2013.01); *A63B 21/4015* (2015.10); *A63B 2208/0204* (2013.01)

(58) Field of Classification Search

CPC ... A63B 5/20; A63B 26/003; A63B 21/00043; A63B 21/0557; A63B 21/4015; A63B 2208/0204

See application file for complete search history.

(56) References Cited

U.S. PATENT DOCUMENTS 3,511,500 A 5/1970 Dunn
4,822,039 A * 4/1989 Gonzales ..... A63B 21/04 482/128
4,973,046 A * 11/1990 Maxwell ..... A63B 21/00178 482/60
5,261,866 A * 11/1993 Mattox ..... A63B 21/0552 482/125
5,393,282 A * 2/1995 Maclean ..... A63B 69/0022 482/51
6,203,476 B1 * 3/2001 Wang ..... A63B 21/0552 482/121
6,361,516 B1 * 3/2002 Hamel ..... A61F 5/0111 128/882
6,425,844 B1 * 7/2002 Azar ..... A61H 1/0259 482/123
6,629,913 B2 * 10/2003 Chen ..... A63B 21/0004 482/121
7,175,574 B2 * 2/2007 Carmel ..... A63B 21/0004 482/124

(Continued)

FOREIGN PATENT DOCUMENTS

GB 2529855 9/2016

OTHER PUBLICATIONS https://www.amazon.com/Bodylastics-Resistance-Protective-Reinforced-Stitching/dp/B00U7NM8P0/ref=sr_1_15? dchild=1&gclid=Cj0KCQjwjOrtBRCcARIsAEq4rW71bSUpsBVWNG8tvg8ZzTdrLwNILF1inK9RF-e1dM2DPZqfuq3CbH8aAv3KEALw_wcB&hvadid=237382550075&hvdev=c&hvlocphy=9021571&hvnetw=g&hvpos=1t2&hvqmt=e&hvrand=5925875160377554201&hvtargid=kwd-389502579306&hydadcr=9652_9895418&keywords=gorila+bow&qid=1572562852&sr=8-15; Publication Date: Dec. 27, 2015.

(Continued)

*Primary Examiner* — Nyca T Nguyen
(74) *Attorney, Agent, or Firm* — Michael P. Mazza; Michael P. Mazza, LLC

(57) ABSTRACT

A physical therapy device with a pair of handles and one or more balance pedals. The balance pedal(s) are slidable along one or more bands attached, directly or indirectly, to the handles.

10 Claims, 7 Drawing Sheets

(56) References Cited

U.S. PATENT DOCUMENTS 7,387,599 B1 * 6/2008 Hsu ..... A61H 15/0092 482/122
7,578,775 B2 * 8/2009 Terry ..... A63B 21/0004 482/121
7,591,763 B1 * 9/2009 Fucci ..... A63B 21/0552 482/121
D605,712 S 12/2009 Bizzell
7,674,209 B2 * 3/2010 Greene ..... A63B 23/03508 482/121
7,780,581 B1 * 8/2010 Emmert ..... A63B 25/10 482/75
8,033,966 B2 * 10/2011 Ayoub ..... A63B 23/12 482/121
8,142,336 B1 * 3/2012 Yates ..... A63B 23/0405 482/124
8,715,146 B2 5/2014 Bronston
8,944,973 B2 * 2/2015 Lalaoua ..... A63B 21/4034 482/122
9,039,583 B2 5/2015 Huang
10,272,291 B2 * 4/2019 Santos ..... A63B 71/0622
2002/0198081 A1 * 12/2002 Chen ..... A63B 21/00043 482/23
2004/0220018 A1 * 11/2004 Branson ..... A63B 22/20 482/51
2005/0049123 A1 3/2005 Dalebout
2006/0052223 A1 * 3/2006 Terry ..... A63B 21/0004 482/126
2008/0293550 A1 * 11/2008 Campbell ..... A63B 26/00 482/121
2009/0137371 A1 * 5/2009 Fuller ..... A63B 23/1281 482/122
2010/0016132 A1 * 1/2010 Flynn ..... A63B 21/4015 482/122
2010/0255966 A1 * 10/2010 Aucamp ..... A63B 21/0552 482/131
2011/0111935 A1 5/2011 Cole
2011/0312477 A1 * 12/2011 Wiseman ..... A63B 21/0552 482/126
2013/0288866 A1 * 10/2013 Rainey ..... A63B 22/18 482/146
2014/0031148 A1 * 1/2014 Sidley ..... A63B 21/4034 473/446
2014/0274585 A1 * 9/2014 Huang ..... A63B 23/1209 482/79
2015/0119204 A1 * 4/2015 Loane ..... A63B 21/00069 482/71
2015/0250675 A1 * 9/2015 Kalinowski ..... A61H 1/0262 482/69
2016/0206920 A1 * 7/2016 Gillis ..... A63B 21/0414
2017/0128775 A1 * 5/2017 Santos ..... A63B 21/00069
2017/0157467 A1 * 6/2017 Strong Crawley .. A63B 26/003
2017/0319891 A1 * 11/2017 Holt ..... A63B 21/04
2018/0228682 A1 * 8/2018 Bayerlein ..... A61H 1/0274
2018/0318639 A1 * 11/2018 Kim ..... A63B 21/023
2018/0326245 A1 * 11/2018 Davis ..... A63B 22/16
2020/0086159 A1 * 3/2020 Marti ..... A63B 21/0557
2020/0086164 A1 * 3/2020 Marti ..... A63B 21/00185
2020/0086173 A1 * 3/2020 Marti ..... A63B 21/4019
2020/0171346 A1 * 6/2020 Chen ..... A63B 22/205
2020/0282256 A1 * 9/2020 Boyles ..... A63B 22/203
2020/0289865 A1 * 9/2020 Lin ..... A63B 21/026

OTHER PUBLICATIONS https://www.amazon.com/Get-Out-Bucket-Stilts-Blue/dp/B07BY47GXZ; Publication Date: Jul. 23, 2018.
https://60up.com; Publication Date: Aug. 3, 2019.
https://www.amazon.com/s?k=wobble+boards&ref=nb_sb_noss_1; Publication Date: Sep. 13, 2019.
https://www.youtube.com/watch?v=-0t6qqSxucc (dumsamker resistance bands, Publication Date: Apr. 11, 2020).
https://www.yescomusa.com/products/wall-mount-2-tiers-corner-storage-shelf-gradienter-color-opt; Publication Date: Sep. 29, 2020.
https://www.youtube.com/watch?v=jF1Y38ANUaQ (wobble exercise board, Publication Date: Aug. 31, 2018).
https://www.acuhealthcare.com/product/317046/cando-r-balance-board-combo-tm-16-circular-wobble-rocker-board-2-5-height-blue/; Publication Date: Jan. 1, 2015.
https://www.performbetter.com/categories/balance-stabilization/balance-boards; Publication Date: May 16, 2019.
https://www.ncbi.nlm.nih.gov/pmc/articles/PMC5140827/; Publication Date: Nov. 29, 2016.
https://url.emailprotection.link/?btFEgrlB0Vfs3XkgyShkYrUreXzT4atg_4PwoQidmO4lnczmCSM_049EoHeJZ4YW7pHY1KV4iGuX3A0za6jG-lg~~ Publication Date: Jan. 9, 2018.
https://www.amazon.com/gofit-glute-blaster-belt-kit/dp/B01N91U4XQ; Publication Date: Feb. 4, 2017.
https://amazon.com/singhi-resistance-system-workout-sculpts/dp/b07P468K24; Publication Date Feb. 27, 2019.

* cited by examiner

PHYSICAL THERAPY AND FITNESS DEVICE: RESISTANCE BAND WITH PEDALS

VIDEO ATTACHED AS APPENDIX

A video in DVD format is attached as an Appendix to this patent application, illustrating the use of the present invention to provide fundamental balance strengthening benefits. This video is incorporated by reference into this patent application.

BACKGROUND OF THE INVENTION

The present invention generally relates to physical therapy and/or general fitness devices utilizing resistance bands.

Balance is foundational to any and all age groups, whether athletes or not. From a baby learning to walk and gaining their balance, to the gifted athlete or seniors, all can benefit from improved balance. Statistically, falls account for the death every 20 minutes of an older person in the United States. 76% of these falls are lateral or sideways falls, according to the Center for Disease Control. Falls are the top cause of fatal injuries in older adults, and many falls are preventable. One-third of adults aged 65 or older fall each year, while 95% of all hip fractures are caused by falling. In fact, health complications from hip fractures result in a higher female mortality rate than breast cancer. Fallers typically have less muscular strength in their lower extremities than non-fallers, according to the American Council on Exercise (Orr et al. 2008). Falling one time doubles your chance of falling again. Falls presently cost our U.S. health care system over $50 billion annually. Current demographics show an acceleration in the elderly population, which is the group most at risk of falls, with attendant health care costs only increasing.

Optimizing balance and fall prevention requires strengthening the leg muscles, including the hip flexors, hip extensors, hip abductors, knee flexors, knee extensors, ankle dorsiflexors and ankle plantar flexors. Strengthening these leg muscles results in a statistically significant improvement in balance (Journal of Physical Therapy Science 26: 1771-1774, 2014). However, seniors often struggle with balance, as they lose muscle mass with advancing age, while also becoming more afraid of a fall as they age.

Resistance bands have been used to optimize balance and increase leg strength. However, while these bands are excellent tools, they can be dangerous. First, they can easily slip out from under the users' foot and snap up and hit the exerciser. Second, standing on an exercise band is not recommended as the wear and tear from shoes onto the tubing can cause the tubing or band to fray, weaken and break. Accordingly, it would be advantageous to provide a physical therapy and fitness device that enhances balance and strengthens leg muscles, while avoiding these problems encountered with resistance bands.

SUMMARY OF THE INVENTION

The objects mentioned above, as well as other objects, are solved by the present invention, which overcomes disadvantages of prior physical fitness devices using resistance bands, while providing new advantages not previously associated with them.

In a preferred embodiment, a physical therapy and fitness device is provided which includes a pair of handles, each graspable by a user's hand, and one or more balance pedals (preferably a pair), adapted to removably support a user's foot of the user. In the particularly preferred embodiment, the balance pedal(s) are slidable along one or more bands attached, directly or indirectly, to the handles. The bands may be elastic or inelastic, but are preferably elastic.

In one preferred embodiment, the balance pedal(s) stay connected to the user's feet due at least in part to upward forces generated by the user's hands acting upwardly on the band(s) and therefore the pedal(s), and not because it is necessary to tie in or otherwise attach the user's feet to the pedals.

The balance pedal(s) may include an aperture or cavity through which the band(s) pass, thereby permitting the balance pedal to be slidable relative to the band(s) when a lateral force is exerted on the pedal by a user's foot. Preferably, the aperture or cavity is adapted for relatively frictionless sliding contact between the aperture or cavity and the band(s) passing through it.

In one preferred embodiment, a top surface of the balance pedal(s) may include opposing projecting lips to facilitate holding a user's foot in place during use of the device. In another embodiment, the distance between the projecting lips may be adjusted. A top surface of each balance pedal may also include frictional grooves adapted to provide a gripping action between the top surface of each balance pedal and a user's foot.

Preferably, the length of the pedal(s) is less than the length of a user's foot, thereby enabling the foot to rock back-and-forth relative to the pedal during use of the device, further enhancing the stability exercise.

In yet another preferred embodiment, the bands may color-coded to: denote different lengths for seating or standing use; and/or to denote differing resistances.

Definition of Claim Terms

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

"Balance pedal" means a foot support, slidable along an elastic band. Each balance pedal may but need not be connected by an elastic band to a handle.

"Elastic band" means a stretchable band, rope or cord, including but not limited to physical fitness devices commonly known as "resistance bands" or "resistance cords" or "fitness bands" or "fitness cords." (A nylon band is not considered sufficiently "elastic" for purposes of the present invention.)

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 1:
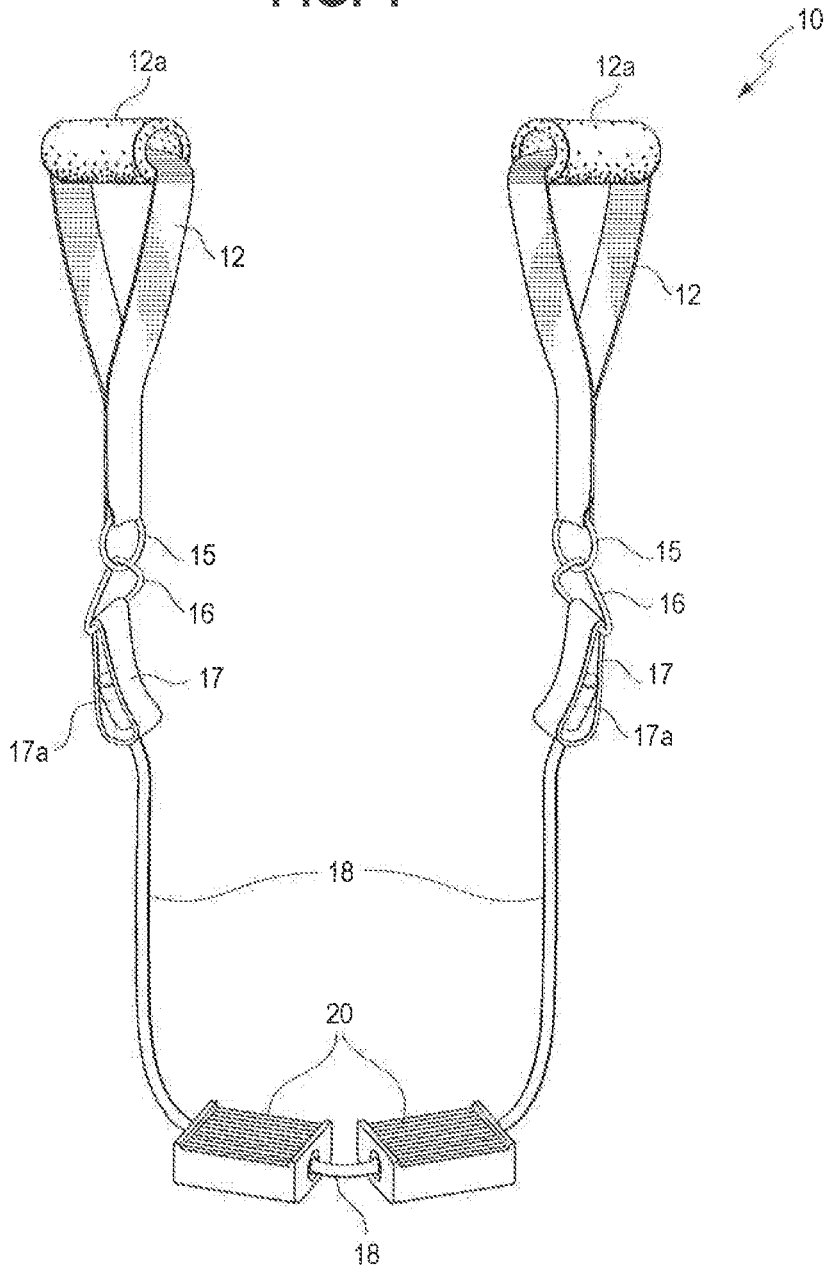
FIG. 1 is a perspective view of a preferred embodiment of a physical fitness device according to the present invention.
Figure 2:
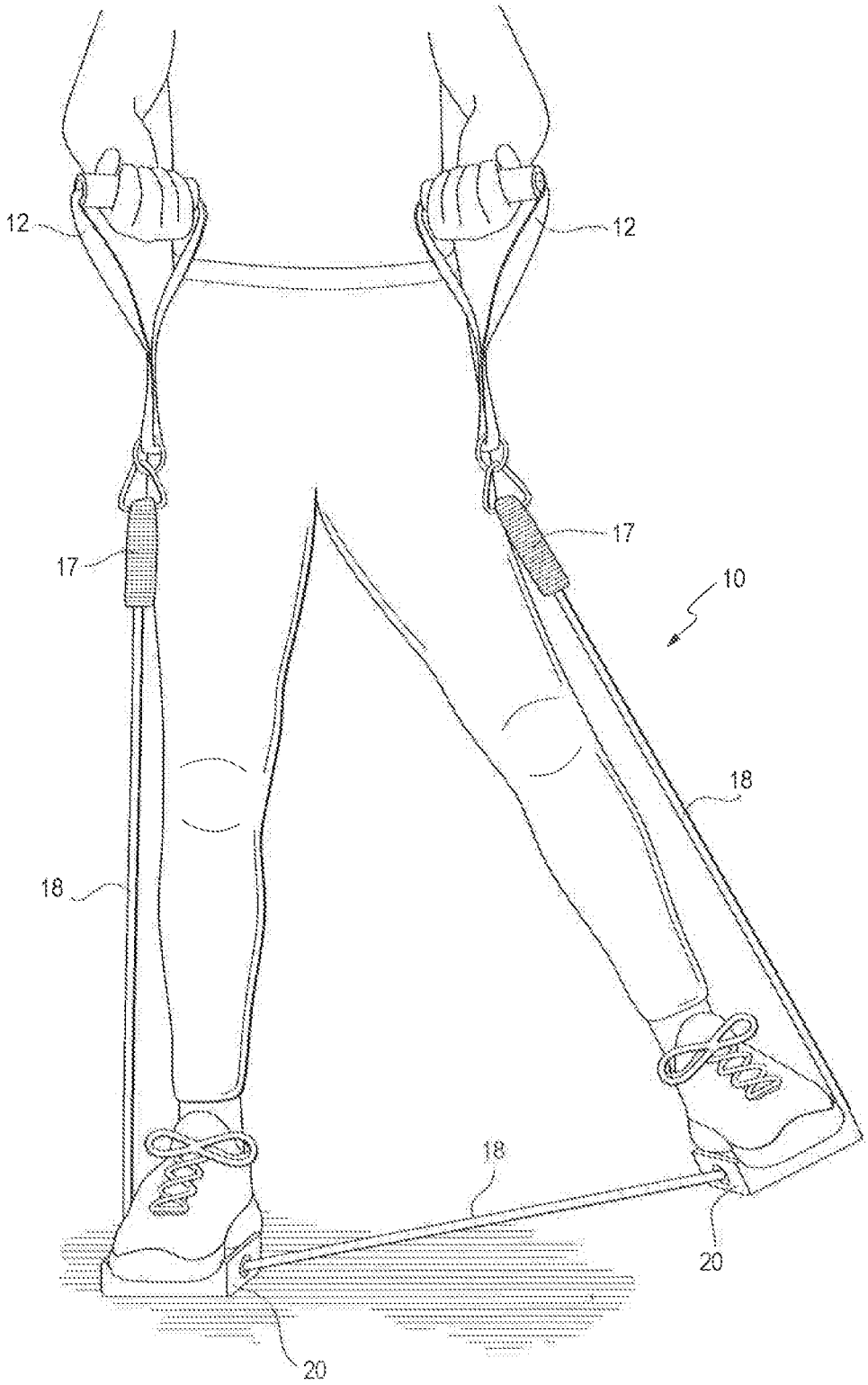
FIGS. 2-3 are views similar to FIG. 1 showing the device in use.
Figure 3:
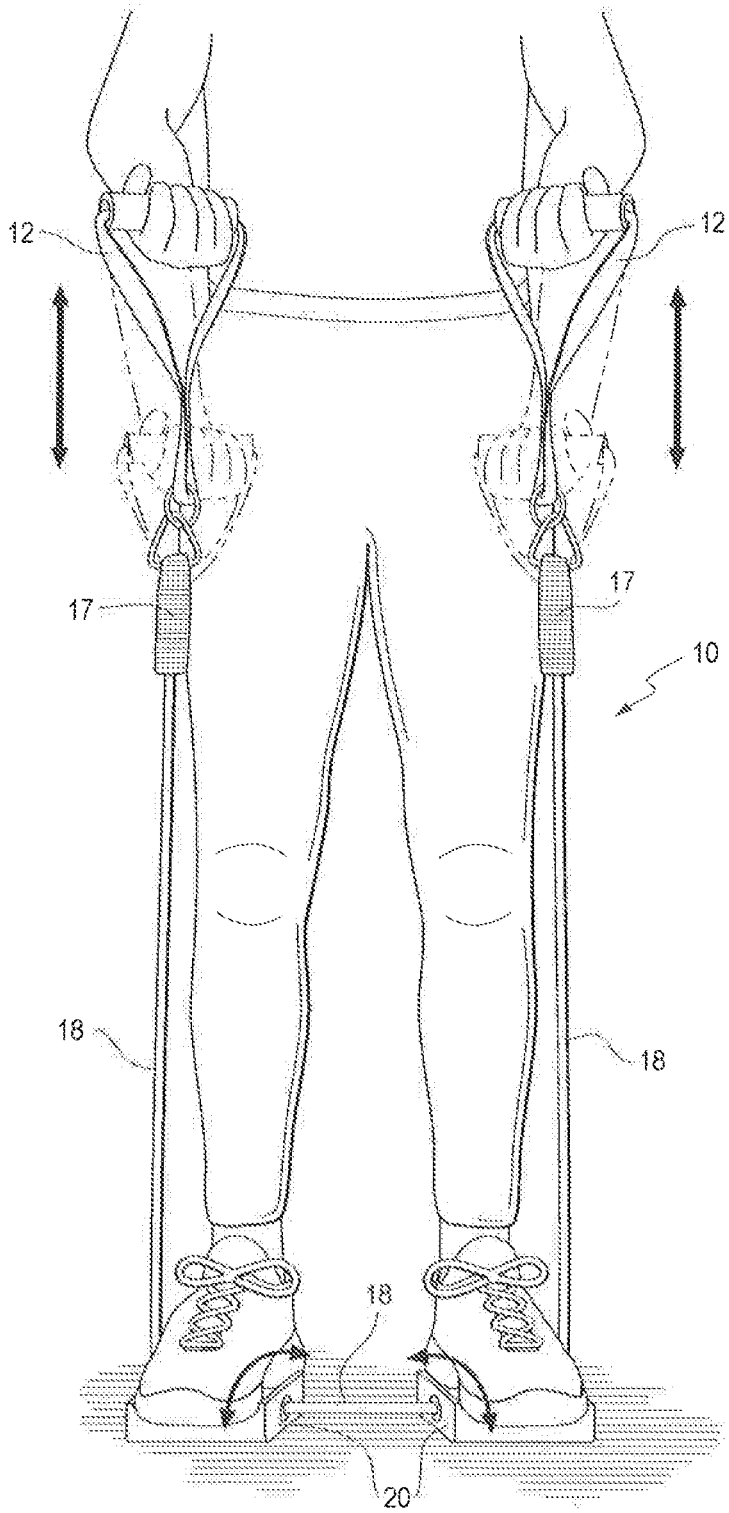
Figure 5:
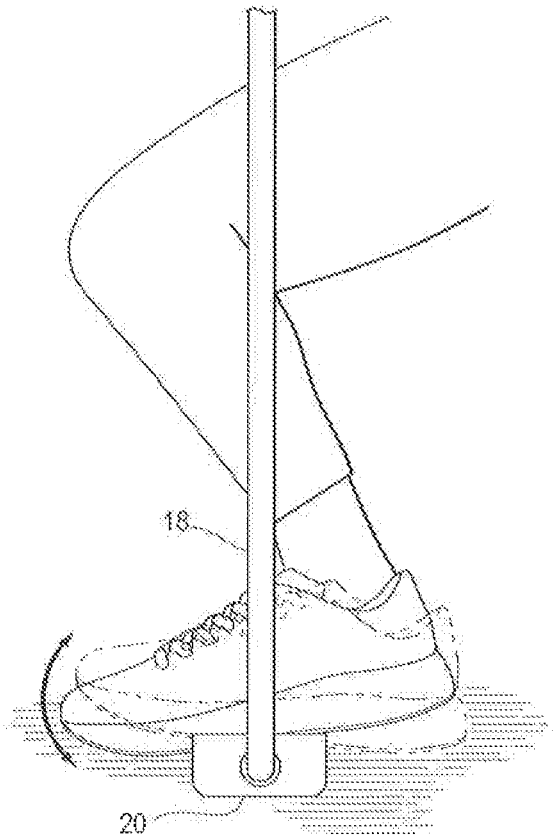

Referring first to FIGS. 1-3, a preferred embodiment of the physical therapy and fitness device, known as the Balance Band™, of the present invention is shown, designated generally by the reference numeral 10. Balance Band™ 10 includes a pair of padded handles 12*a* attached by a (e.g., nylon) strap or cord 12 to a metal ring 15, which is attached to a metal carabiner 16, which is in turn attached to a nylon strap 17 (e.g., 4-inches in length). Nylon strap 17 is attached to an elastic cord or band 18 (e.g., seated version length may be 23-inches, while standing version may be 40-inches) and fastened using plugs 17*a*. Opposing ends of elastic cord or band 18 may each pass through a pedal aperture 21 (see FIG. 5) of a pair of balance pedals 20.

Figure 6:
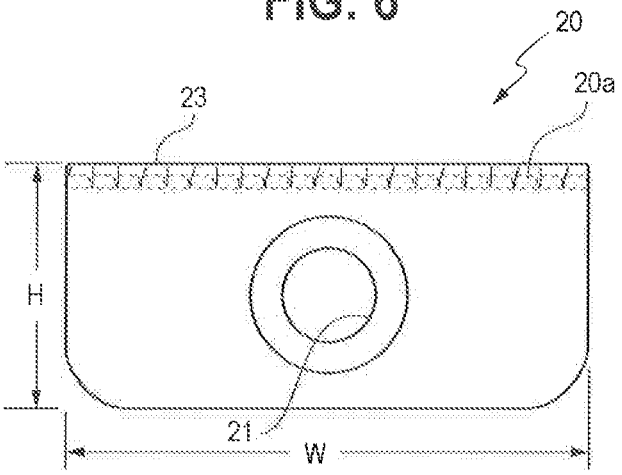
FIGS. 6-7 are enlarged side and perspective views of a pedal of the device.

Referring to FIG. 6, aperture or cavity 21 may be about ¾-inch in diameter, and may be smooth-lined (e.g., with nylon edging) to limit friction and allow balance pedals 20 to slide smoothly along cord/band 18 through pedal apertures 21. The material surrounding apertures or cavities 21 may be splayed, outwardly flaring and beveled to further limit friction between them and the elastic cord/band 18. In an alternative embodiment, rather than running through the pedal, the cavity or aperture may be positioned adjacent a top or bottom surface of the pedal, although it is preferred to locate the cavity or aperture through or closely adjacent to a center-of-mass location of the pedal.

Figure 7:
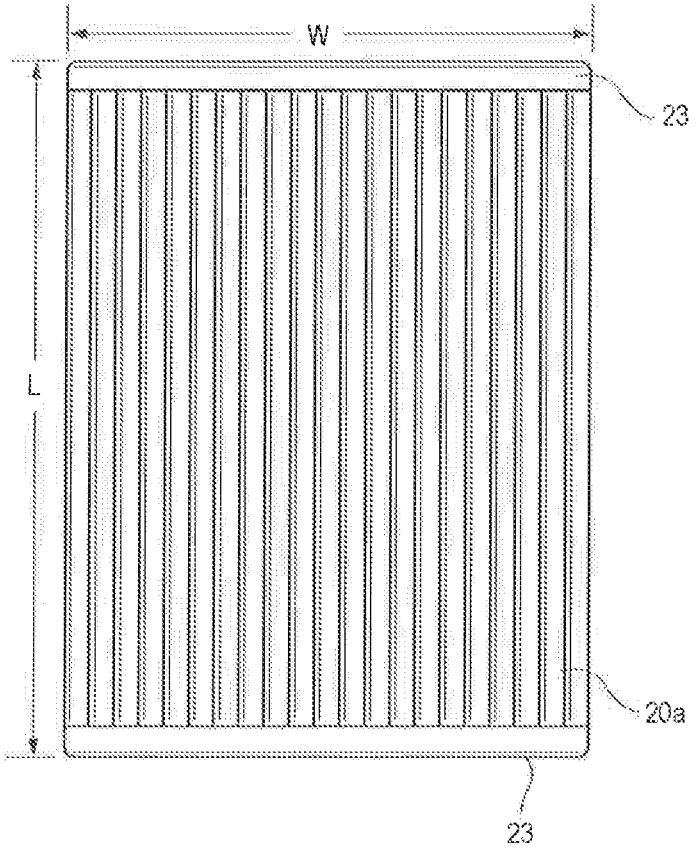

Referring to FIGS. 6-7, balance pedal may be, e.g., about 1-inch in height H, about 3-inches in width W and about 4-inches in length L. The pedal platform is relatively wide for efficient weight distribution. The top surface 20*a* may include rubberized grooves 22 for enhanced gripping between the pedal and a foot, and may also include opposing lips 23 (e.g., ¼-inch height and ⅛-inch wide) positioned at edges of the pedal to assist in holding a foot laterally in place on the pedal. The pedal is preferably designed so that the "Up" side presents itself via gravity.

While FIG. 1 shows the currently-preferred embodiment, persons of ordinary skill will recognize variations may be made from this embodiment, within the scope of the claims. For example, while in the preferred embodiment elastic cord/band 18 is one smooth, integral piece attached to nylon straps 17, elastic cord/band 18 may instead consist of a non-elastic (e.g., nylon) strap or band running from nylon strap 17 until a position upstream of but relatively adjacent each pedal 20, and may thereafter consist of an elastic band/cord. Even the band/cord length associated with and passing through the pedals may be non-elastic, for a given use/preference/user. (User preference, depending upon the user's need and the exercise, may dictate different embodiments in this regard.) Additionally, while elements 15, 16 and 17/17*a* are provided in the preferred embodiment, in another embodiment handle 12 may simply be attached via a strap or otherwise directly to cord/band 18. Still other attachment and connection elements and mechanisms will be understood to those of ordinary skill in the art.

The Balance Band™ has been found to overcome problems associated with resistance bands or resistance balls used alone. The unique design, with the elastic tubing running through relatively frictionless apertures in the pedal, keeps the tubing healthy and safe. The wide design of balance pedal 20 distributes the user's weight evenly and avoids the possibility of slipping. Further, a beginner to the Balance Band™ may use it while seated in a chair, providing enhanced safety. All of the exercises using the Balance Band™ can be performed seated or standing.

Balance pedal 20 allows the user to place a foot securely on the pedal, which distributes the weight evenly on the pedal, which is very different—and much safer—than when a user steps directly on an exercise band. Further, the pedal's unique design, in which the elastic band, cord or tubing runs directly through the pedal's nylon-lined cavity or aperture provides a relatively frictionless connection with the pedals, which maintains the health and integrity of the elastic element, providing it with a longer useful life.

Three exercises in particular have been found to best strengthen the necessary leg muscle groups required to optimize balance: lateral side stepping, glute kickbacks, and lateral leg lifts:

A) Lateral Side Stepping: this movement strengthens the lateral (outside) leg muscles, as well as the tops of feet and the lateral hips.

B) Glute Kick Backs: this movement strengthens the back of the legs as well as the buttocks.

C) Lateral Leg Lift: this movement one strengthens the lateral hip abductors (outside hip).

Figure 4:
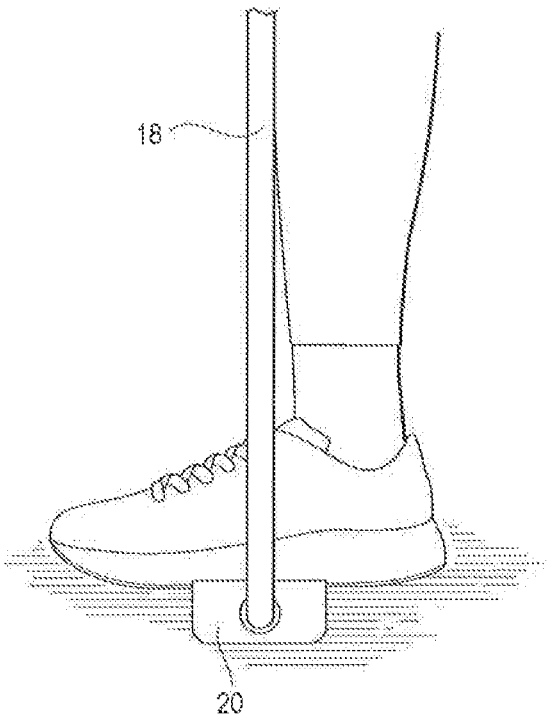
FIGS. 4-5 are partial side perspective views of a lower portion of the device in use.

A person of ordinary skill will recognize that each of these exercises can be performed using physical fitness device 10 of the present invention. The Balance Band™ is unique in the manner in which it allows a user to strategically pinpoint these muscles important to balance, and to perform the movements as described above. In addition to the general overall strengthening of lower extremity muscles through the use of the present invention, the pedals also provide an additional benefit: as the foot is not fully supported, but rather is permitted to rock back and forth on the pedal, these perturbations or disturbances require the user to continuously seek to regain stability, which further enhances balance. Thus, referring to FIGS. 4-5, pedal 20 allows the foot to pivot back-and-forth (front-to-back as shown by the arrow on FIG. 5). Put another way, the user's foot placement on the pedals inherently creates balance instability, causing the body to react and regain balance, which further enhances overall stability. Pedals 20 thus enable a user to accurately, effectively and evenly distribute their weight on each pedal by allowing foot placement in an optimal position to effectively achieve the desired balance strengthening benefits.

Referring to FIG. 7, in yet another alternative embodiment, the distance between opposing lips 23 may be adjusted (in any number of ways, using pins, ratchets or other mechanisms) to adjust for individual foot width, enabling a snugger placement of the foot on a pedal. The top surface of pedals 20 may be flat/planar (as shown in FIGS. 1-8, for example), or alternatively may be indented or made concave to better fit the foot during use, as shown in FIG. 9; however, for safety, the foot should not be tied in or affixed to the pedal in any type of manner that is not immediately removable from the pedal.

Figure 8:
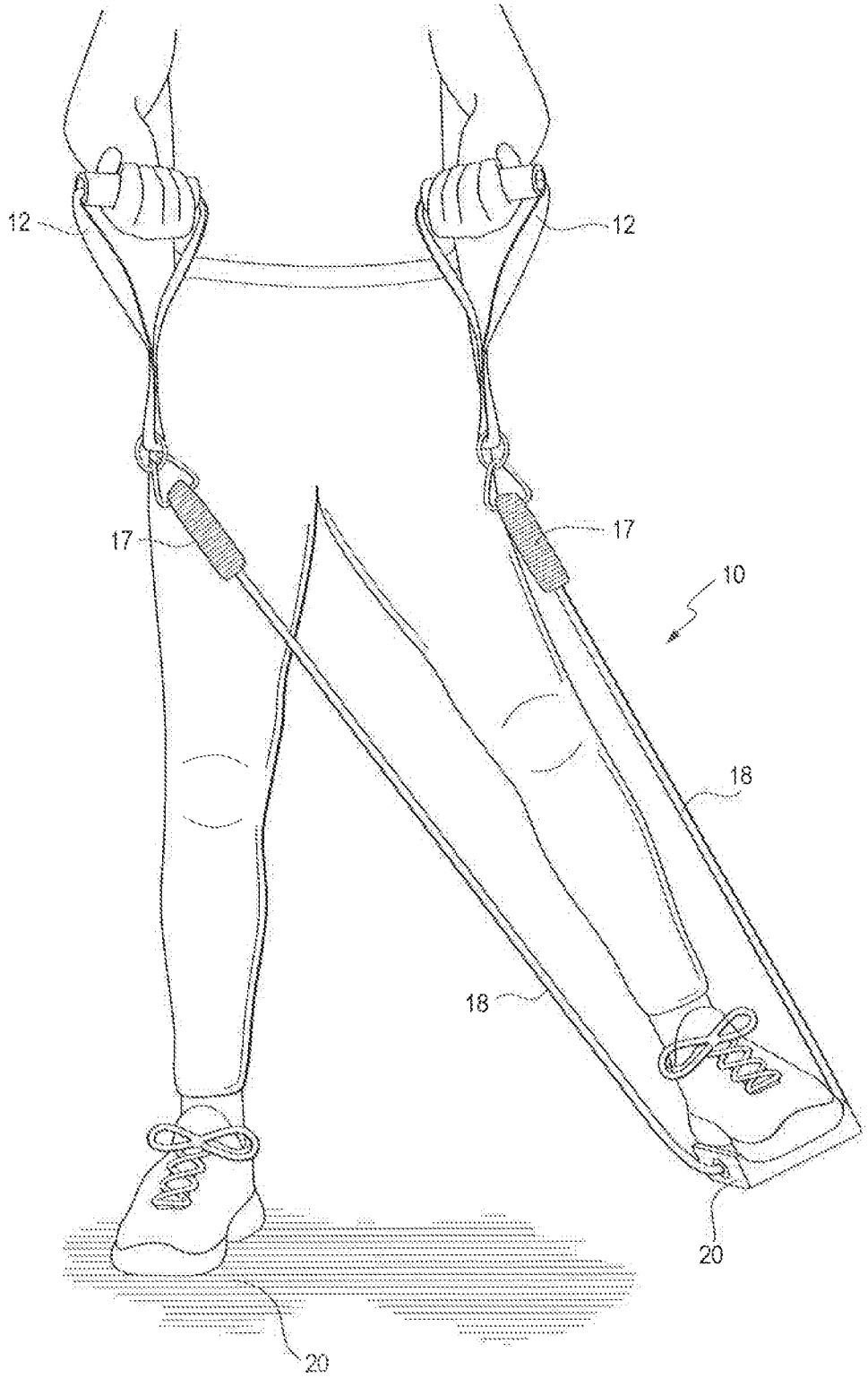
FIG. 8 is a view similar to FIG. 1 showing a one-pedal device in use.
Figure 9:
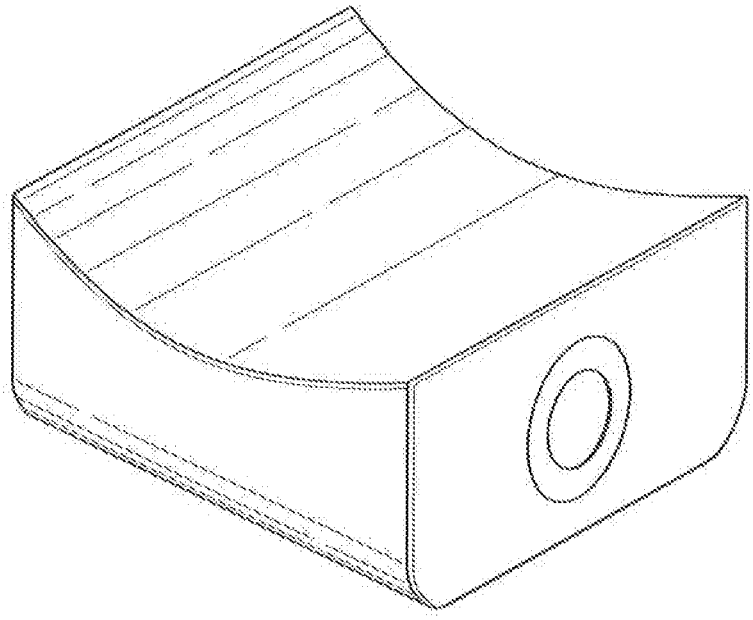
FIG. 9 is an enlarged side and front perspective view of an alternative embodiment of a pedal useful in the present invention.

In an alternative embodiment, shown in FIG. 8, only one pedal need be used. Standing on the ground while lifting the pedal-secured foot can be done, as shown in FIG. 8. Alternatively, utilizing the "wobble board" effect, and for an even greater degree of difficulty, the user can stand on the pedal (which is lying on the ground) and then lift, with control, the non-pedal-secured foot (not shown). These single-limb exercises are excellent for balance and strength, and can prove to be more difficult to use than the dual-pedal device.

The Balance Band™ enables users to exercise from their own home, while improving your balance at a very low cost. It has great flexibility, too, as the youngest athlete can use it to improve their game, while the oldest adult can use it to strengthen their legs and reduce the risk of falling. Further, because balance pedals 20 can be slid up and down the band, they can be moved to the side and the elastic band can be used for a number of additional exercises, such as triceps strengthening. Triceps are considered a "go-go" muscle by the exercise community, as they are needed to push ourselves up to get out of a chair. (If a user can't get out of a chair, he/she is house-bound, equating to a loss of independence). The Balance Band™ also enables users to perform triceps extensions, further empowering users and allowing them to maintain their independence.

Different elastic bands or cords may be color-coordinated to facilitate use. For example, yellow (e.g., 23-inches in length) may be used for seated balance/strength work. Other colors for bands/cords may be used for standing work (e.g., 40-inches in length), with different colors denoting different band/cord thicknesses (and thus differing resistances) selected for the level of the user (e.g., green for beginners, red for intermediate users, and blue for advanced users). Each colored band/cord is preferably interchangeable with the comfort grip handle system.

In a less preferred embodiment, the pedal(s) could be affixed to the band(s), so that the pedal(s) do not slide along the band(s). With this embodiment, the band(s)' width could be widened or thickened in the area adjacent the pedal(s), to strengthen the band(s)/pedal(s) connection.

The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

I claim:

1. A physical therapy and finless device, comprising:

a band system comprising one or more bands having opposing ends;

a pair of handles, each of the handles attached at an opposing end of the band system and graspable by a hand of a user of the device, wherein each handle is independently movable by the user relative to the other handle;

a pair of balance pedals, each pedal being adapted to removably support one of the users feet during, use of the device, and each pedal being slidable along at least a portion of the band system; wherein each balance pedal includes an aperture or cavity extending through said balance pedals through which the one or more bands pass, and wherein a top surface of each balance pedal includes opposing projecting lips to facilitate holding the user's foot in place during use of the device, wherein during use of the device one of the balance pedals remains on the ground, supporting one of the user's feet, while the other balance pedal supports and is capable of being pushed laterally by the other of the user's feet, against resistance created by the band system, so that the other balance pedal slides along a portion of the band system, in a direction generally perpendicular to the balance pedal on the ground, thereby causing the laterally-pushed balance pedal to move laterally relative to the balance pedal on the ground.

2. The physical therapy and fitness device of claim 1, wherein permitting the balance pedal to b slidable relative to the one or more bands when a lateral force is exerted on the pedal by the user's foot.

3. The physical therapy and fitness device of claim 2, wherein the aperture or cavity is adapted for relatively frictionless sliding contact between the aperture or cavity and the one or more bands passing through it.

4. The physical therapy and fitness device of claim 1, wherein during exercise each balance pedal is independently movable by the user's foot relative to the other pedal.

5. The physical therapy and fitness device of claim 1, wherein the balance pedals are configured to remain in contact with the user's feet due to gravity and upward forces generated by the user's hands acting upwardly on the one or more bands and the balance pedals, and not due to tying m or otherwise attaching the user's feet to the pedals.

6. The physical therapy and fitness device of claim 1, wherein the one or More bands comprise one or more elastic bands.

7. The physical therapy and fitness device of claim 1, wherein the distance between the projecting lips is configured to be adjustable.

8. The physical therapy and fitness device of claim 1, wherein a length of the balance pedals are configured to be less than a length of an average user's foot, thereby enabling the foot to rock back-and-forth relative to the pedal during use of the device.

9. The physical therapy fitness device of claim 1, wherein the one or more bands are color-coded to denote bands having different lengths useful for seating or standing use.

10. The physical therapy and fitness device of claim 1, wherein the one or more bands are color-coded to denote hands having differing resistances.

* * * * *